US006042509A

United States Patent [19]

Wu et al.

[11] Patent Number: 6,042,509

[45] Date of Patent: Mar. 28, 2000

[54] DEVICE FOR PROMOTING HUMAN ABDOMINAL BREATHING

[76] Inventors: Race Wu, 3F, No. 82, Yi-Ping Rd., Yi-Hsin Village, Tai-Ping City Taichung Hsien, Taiwan; Ching-Tien Hsien, No.10, Lane 185, Hsin-Hsing Rd., Taichung, Taiwan

[21] Appl. No.: 08/917,771

[22] Filed: Aug. 27, 1997

[51] Int. Cl.[7] ..... A61H 31/00

[52] U.S. Cl. ..... 482/13; 482/4; 128/204.18

[58] Field of Search ..... 482/1–9, 13, 900–902; 128/200.24, 204.18, 205.11, 205.13–205.17, 206.21; 434/262

[56] References Cited

U.S. PATENT DOCUMENTS 4,798,538 1/1989 Yagi ..... 434/262
5,547,440 8/1996 Rubens et al. ..... 482/13
5,658,221 8/1997 Hougen ..... 482/13
5,738,089 4/1998 Hoshi et al. ..... 128/204.18

*Primary Examiner*—Glenn Richman
*Attorney, Agent, or Firm*—Browdy and Neimark

[57] ABSTRACT

An abdominal breathing device is composed of an air pump, an inhaling-exhaling mechanism, and an air bag connected with the inhaling-exhaling mechanism by an air tube. The air bag is strapped around the abdomen of a person undertaking the abdominal breathing and is then inflated by the air pump in conjunction with the inhaling-exhaling mechanism, so as to force the abdomen of the person to contract to exhale air. The inflated air bag is deflated by the abdominal expansion caused by the inhaling of air by the person in conjunction with the inhaling-exhaling mechanism.

10 Claims, 1 Drawing Sheet

DEVICE FOR PROMOTING HUMAN ABDOMINAL BREATHING

FIELD OF THE INVENTION

The present invention relates generally to a health device, and more particularly to a device for promoting the human abdominal breathing.

BACKGROUND OF THE INVENTION

According to the Chinese Taoist philosophy and the Hindu yoga, one can achieve good health and longevity through the controlled breathing, which is in fact the so-called "abdominal breathing" and is a system of exercise involving discipline.

The process of respiration of a human body is normally attained through the "thoracic breathing" by which air is inhaled and exhaled. In other words, the thoracic breathing is attained through contraction and relaxation of the thoracic cavity. It is therefore readily apparent that the "abdominal breathing" is not a natural process by which the body respiration of a person is achieved. For this reason, one must learn to do the "abdominal breathing" through practice and discipline.

SUMMARY OF THE INVENTION

The primary objective of the present invention is therefore to provide a device for assisting a person to engage in the abdominal breathing effectively.

In keeping with the principle of the present invention, the foregoing objective of the present invention is attained by a device consisting of an air pump for inflating an air bag. The inflated air bag forces the abdomen of a user of the device to contract so as to bring about the exhaling of air. The exhaling of air results in the expansion of the abdomen of the user, thereby causing the air bag to deflate.

The foregoing objective, features and functions of the present invention will be more readily understood upon a thoughtful deliberation of two embodiments of the present invention with reference to the accompanying drawings.

DETAILED DESCRIPTION OF THE INVENTION

Figure 1:
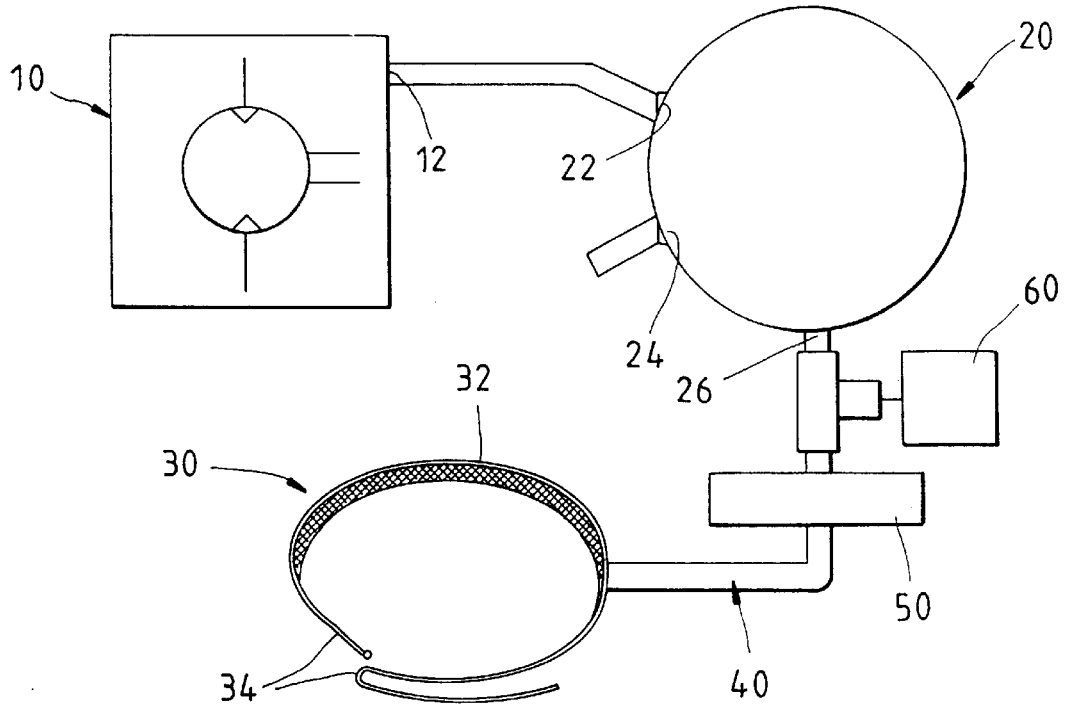
FIG. 1 shows a schematic view of a first preferred embodiment of the present invention.

As shown in FIG. 1, an abdominal breathing device of a first preferred embodiment of the present invention is composed of an air pump 10 having an air outlet 12, an inhaling-exhaling mechanism 20 consisting of an air inlet 22, an air discharging port 24, and an inflation port 26. The air outlet 12 of the air pump 10 is in communication with the air inlet 22 of the inhaling-exhaling mechanism 20. When the air inlet 22 is connected with the inflation port 26, an air bag 32 of the inflation unit 30 is inflated by air via an air tube 40. The air bag 32 is provided with a waist strap 34 by which a user of the device can fastened the air bag 32 around the abdomen of the user. As the air bag 32 is inflated to put pressure on the abdomen of the user, the abdomen is contracted to bring about the exhaling of air by the user. On the other hand, when the air discharging port 24 is connected with the inflation port 26, the air supply to the air bag 32 from the pump 10 is shut off. The user of the device can now inhale air to expand his or her abdomen. The expansion of abdomen forces some of air in the air bag 32 to flow back to the air tube 40, thereby resulting in the discharge of the air of the air bag 40 via the air discharging port 24. The inhaling process and the exhaling process described above are repeated to bring about the abdominal breathing. The air tube 40 is provided with an air flow adjusting apparatus 50 for regulating the amount of air flowing into the air bag 32 per unit time. As a result, the user of the device can control the pace of the abdominal breathing by the air flow adjusting apparatus 50. In order to personalize further the device of the present invention, the present invention is provided with an air valve 60 located between the inflation port 26 and the air flow adjusting device 50. The user of the device can adjust the air pressure of the air bag 32 by the air valve 60 such that the inflated air bag 32 does not cause discomfort to the abdomen of the user.

Figure 2:
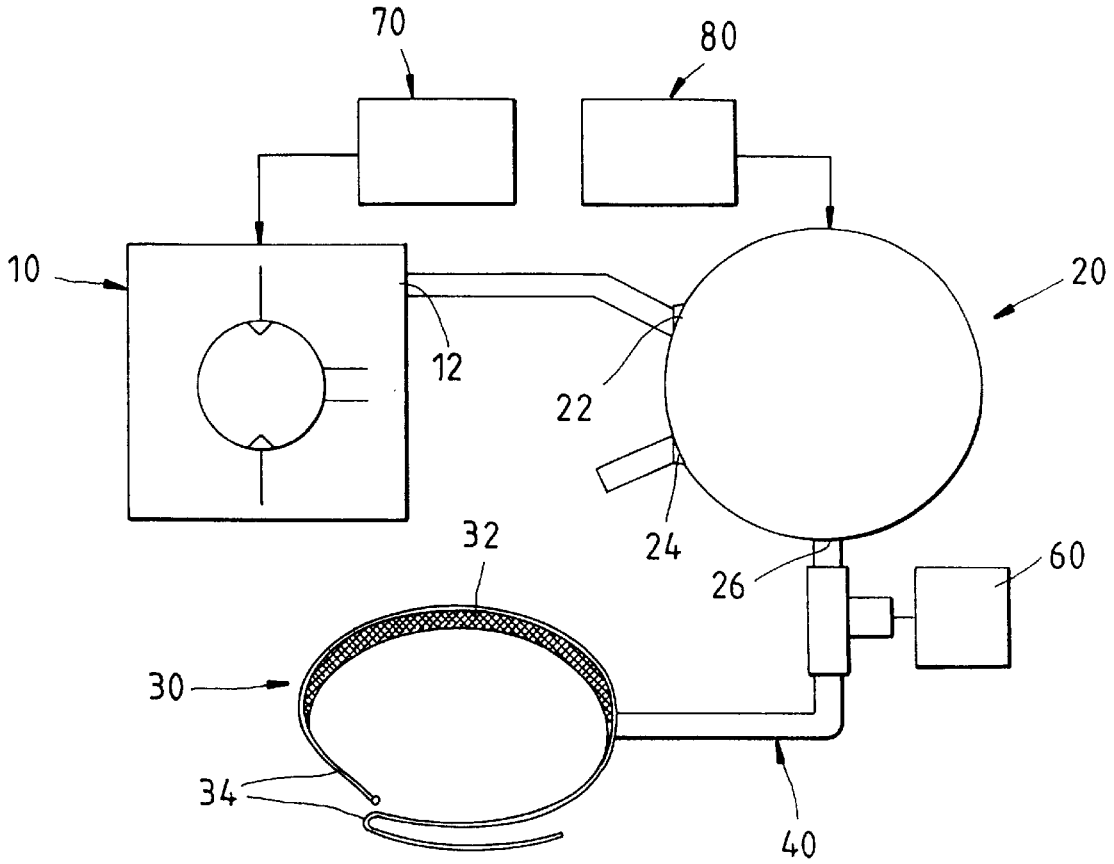
FIG. 2 shows a schematic view of a second preferred embodiment of the present invention.

As shown in FIG. 2, an abdominal breathing device of a second preferred embodiment of the present invention is basically similar in construction to the device of the first preferred embodiment described above, with the difference being that the former comprises an air pump control apparatus 70 and an inhaling -exhaling mechanism control apparatus 80. The air pump control apparatus 70 is intended to regulate the operating power of the air pump 10 such that the inflation rate of the air bag 32 can be controlled by the user. The inhaling-exhaling mechanism control apparatus 80 enables the user of the device to regulate the inhaling duration and the exhaling duration. In fact, the air pump 10, the inhaling-exhaling mechanism 20, the air pump control apparatus 70, and the inhaling-exhaling mechanism control apparatus 80 can be designed on a circuit board such that they are electronically controlled and operated.

What is claimed is:

1. An abdominal breathing device comprising:

an air pump provided with an air admission port and an air outlet;

an inhaling-exhaling mechanism consisting of an air inlet in communication with said air outlet of said air pump, said mechanism further consisting of an air discharging port and an inflation port;

an air bag inflatable by said air pump via said inhaling-exhaling mechanism, said air bag capable of being fastened around abdomen of a person; and an air tube connecting said air bag and said inhaling-exhaling mechanism;

said air bag capable of being inflated by said air pump at such time when said inflation port is connected with said air inlet, so as to cause the abdomen of the person to contract to exhale air;

said inflated air bag capable of being deflated by an abdominal expansion caused by the inhaling of air by the person at such time when said inflation port is connected with said discharging port.

2. The abdominal breathing device as defined in claim 1, wherein said air bag is provided with a means for fastening said air bag with abdomen of a person.

3. The abdominal breathing device as defined in claim 1, wherein said air tube is provided with an air flow adjusting apparatus for regulating amount of air flowing into said air bag per unit time.

4. The abdominal breathing device as defined in claim 3, wherein said air tube is provided with an air valve located between said inflation port and said air flow adjusting apparatus for adjusting air pressure of said air bag.

5. The abdominal breathing device as defined in claim 1, wherein said air pump is provided with an air pump control apparatus for regulating the operating power of said air pump.

6. The abdominal breathing device as defined in claim 1, wherein said inhaling-exhaling mechanism further consists of a control apparatus for regulating an exhaling duration and an inhaling duration.

7. The abdominal breathing device as defined in claim 5, wherein said air tube is provided with an air valve for adjusting air pressure of said air bag.

8. The abdominal breathing device as defined in claim 7, wherein said inhaling-exhaling mechanism further consists of a control apparatus for regulating an exhaling duration and an inhaling duration.

9. The abdominal breathing device as defined in claim 5, wherein said air pump and said air pump control apparatus are electronically controlled and operated.

10. The abdominal breathing device as defined in claim 6, wherein said inhaling-exhaling mechanism and said control apparatus are electronically controlled and operated.

* * * * *